US006928253B2

(12) United States Patent
Ojima et al.

(10) Patent No.: US 6,928,253 B2
(45) Date of Patent: Aug. 9, 2005

(54) IMAGE FORMING APPARATUS INCLUDING TONER CHARGING MEMBER

(75) Inventors: Masaki Ojima, Shizuoka (JP); Masahide Kinoshita, Shizuoka (JP); Motoki Adachi, Shizuoka (JP); Masao Uyama, Shizuoka (JP); Kazuhiro Okubo, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 97 days.

(21) Appl. No.: 10/691,504

(22) Filed: Oct. 24, 2003

(65) Prior Publication Data

US 2004/0086298 A1 May 6, 2004

(30) Foreign Application Priority Data

Oct. 25, 2002 (JP) ..... 2002-311858
Oct. 15, 2003 (JP) ..... 2003-355204

(51) Int. Cl.[7] ..... G03G 21/00
(52) U.S. Cl. ..... 399/129
(58) Field of Search ..... 399/128, 129, 399/149, 150, 353, 354

(56) References Cited

U.S. PATENT DOCUMENTS 4,851,960 A 7/1989 Nakamura et al. ..... 361/225
5,083,169 A * 1/1992 Usui et al. ..... 399/353
RE35,581 E 8/1997 Nakamura et al. ..... 361/225
5,970,285 A * 10/1999 Ito et al. ..... 399/149
6,421,512 B2 7/2002 Watanabe et al. ..... 399/149
6,640,063 B2 10/2003 Adachi et al. ..... 399/50
2003/0077088 A1 4/2003 Adachi et al. ..... 399/129

FOREIGN PATENT DOCUMENTS

JP 63-149669 6/1988
JP 8-137368 5/1996
JP 2001-215799 8/2001

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

An image forming apparatus includes a photosensitive drum, a charging roller, a transfer roller, and a toner charging brush, wherein the toner charging brush reciprocates in a longitudinal direction of the photosensitive drum. In the image forming apparatus, when a number of rotations per a unit time of the image bearing member is assumed to be "a" and a number of times of reciprocation per unit time of the toner charging brush is assumed to be "b", assuming that R=b/a, R is set to be in a range of $1/25 \leqq R \leqq 3$. However, R=m/n (m and n are integers of 5 or less) is excluded. Consequently, generation of a periodic attachment pattern appearing on the photosensitive drum is eliminated.

27 Claims, 9 Drawing Sheets

IMAGE FORMING APPARATUS INCLUDING TONER CHARGING MEMBER

BACKGROUND OF THE INVENTION

1. Field of the Invention

The present invention relates to an image forming apparatus such as a copying machine, a printer, or a facsimile machine using an electrophotographic system.

2. Related Background Art

Conventionally, an image forming apparatus of a transfer system such as a copying machine, a printer, a facsimile machine using an electrophotographic system includes: an electrophotographic photosensitive member (photosensitive member) serving as an image bearing member, generally of a rotary drum type; an electrostatic charging device (charging step) for uniformly charging the photosensitive member to predetermined polarity and potential; an exposure device (exposure step) serving as information writing means which forms an electrostatic latent image on the charged photosensitive member; a developing device (developing step) which visualizes the electrostatic latent image formed on the photosensitive member as a developer image (toner image) with a toner serving as a developer; a transfer device (transfer step) which transfers the toner image from the surface of the photosensitive member to a transferring material such as paper; a cleaning device (cleaning step) which removes the developer somewhat remaining on the photosensitive member after the transfer step (residual toner, transfer residual toner) to clean the surface of the photosensitive member; and a fixing device (fixing step) which fixes the toner image on the transferring material. The photosensitive member is repeatedly subjected to an electrophotographic process (charging, exposure, development, transfer, and cleaning), serving for image formation.

Therefore, in the conventional image forming apparatus, a waste toner recovering container, receives the transfer residual toner removed from the surface of the photosensitive member by the cleaning device, is required, and maintenance for waste toner treatment is also required. In an image forming apparatus with a durable life thereof being set long, it is inevitable to either increase the number of times of maintenance or to increase the size of the waste toner recovering container. If the latter is selected, significant limitation is imposed in terms of reduction in size of the apparatus.

Thus, a cleaning-less image forming apparatus called "cleaning simultaneous with developing system" has been proposed, in which the cleaning device having the waste toner recovering container is removed and the transfer residual toner on the photosensitive member after the transfer step is removed and recovered by the developing device to be reused.

In the "cleaning simultaneous with developing system", the photosensitive member is continuously charged and exposed to form an electrostatic latent image thereon while keeping the transfer residual toner after the transfer step on the photosensitive member. In the next development step, the transfer residual toner existing in a part on the photosensitive member which should not be developed (non-exposure part, non-image part) is recovered in the developing device with in accordance with "a fog removing bias (a fog removing potential difference Vback which is a potential difference between a DC voltage applied to the developing device and a surface potential of the photosensitive member) ". Since the transfer residual toner recovered in the developing device by this system is reused in the development step in the following process, a waste toner is never generated. Thus, the maintenance conventionally required for treatment of the waste toner is never required., and the waste toner container can be removed. Therefore, the cleaning simultaneous with developing system is advantageous for reduction in size of the image forming apparatus.

On the other hand, in recent years, as the charging means, a roller charging system using an electroconductive roller as a contact charging member is particularly preferably used instead of a corona charger from the viewpoint of stability of charging. In the roller charging system, an electroconductive elastic roller (charging roller) is pressurized and brought into abutment against a member to be charged, and a voltage is applied thereto, thereby charging the member to be charged.

Concerning this charging system, as disclosed in Japanese Patent Application Laid-Open No. S63-149669, there is proposed an AC charging system in which a voltage is applied to the contact charging member. The voltage to be applied is obtained by superimposing an AC voltage component having a peak-to-peak voltage equal to or higher than 2×Vth (discharge initiating voltage) on a DC voltage equivalent to a desired surface potential Vd of the charged member. Such AC charging system is put to practical use. The AC charging system can realize more stable uniformization of charging due to a leveling effect of a potential by an AC voltage than the DC charging system using only a DC voltage.

In the cleaning-less image forming apparatus of the "cleaning simultaneous with developing system", in the case in which the contact electrostatic charging device is used, when the transfer residual toner on the photosensitive member passes a contact portion between the photosensitive member and the contact charging member, a part of the transfer residual toner may attach on the surface of the contact charging member to contaminate the contact charging member. If such toner contamination of the contact charging member exceeds an allowable degree, charging failure may be caused.

The toner contamination worsens because a toner having a charged polarity reversed to a polarity opposite to a normal polarity (hereinafter referred to as "reversal toner") or a toner, which has a low amount of charging and is hardly peeled from a photosensitive drum even if it is charged in the normal polarity (hereinafter referred to as "low charge toner"), exists in the transfer residual toner. This reversal toner or low charge toner electrostatically attaches on the contact charging member more easily than a toner of the normal polarity.

It is known that an existence ratio of the reversal toner or the low charge toner to the transfer residual toner increases due to an influence of a transfer bias voltage or peeling discharge in the transfer step compared with an existence ratio of the reversal toner or the low charge toner to the toner supplied for development from the developing device. This was a cause of worsening the toner contamination.

In addition, in order to remove and recover the transfer residual toner on the photosensitive member by "cleaning simultaneous with developing" with the developing device, a charged polarity of the transfer residual toner on the photosensitive member which is carried to a development portion is required to be a normal polarity, and an amount of charging thereof is required to be an amount of charging of the same level as a normal toner in the developing device. The reversal toner and the low charge toner in the transfer residual toner cannot be removed and recovered in the developing device from the photosensitive drum, causing image failure.

Thus, as disclosed in Japanese Patent Application Laid-Open No. H8-137368, there is proposed an image forming apparatus which is provided with a developer charging means (toner charging means) in the upstream of charging means, which charges a photosensitive member, in a rotational direction of the photosensitive member.

A DC voltage equal to or higher than a discharge initiating voltage in a normal polarity is applied to the toner charging means. A transfer residual toner passing the toner charging means is charged to the normal polarity by sufficient discharge. In the charging step performed by the contact charging member, the photosensitive member is charged together with the transfer residual toner. However, since the transfer residual toner is uniformly charged to the normal polarity by the toner charging means, the attachment of the transfer residual toner on the contact charging member is suppressed. In addition, since charge of the transfer residual toner is appropriately removed due to an AC voltage applied to the contact charging member, a toner having excessive charge and adhering to the photosensitive member with a reflection force is also removed. Removal and attachment of a toner is performed efficiently by "cleaning simultaneous with developing".

However, although the transfer residual toner is given a sufficiently charge by the toner charging means if an amount of the transfer residual toner is little, a transfer residual toner image pattern may remain as it is to cause a ghost image thereof. In addition, under conditions that degrades transfer property of a toner image (e.g., high humidity environment, low resistance value of a transferring material, etc.), the amount of the transfer residual toner increases. When the transfer residual toner equal to or more than an allowable amount concentrates in a part of the toner charging means, development in which the toner charging means cannot fully control an amount of charging of the transfer residual toner in that part (development with transfer residual toner charging failure) may occur to cause a fogged image due to contamination of the charging member.

Thus, as disclosed in U.S. Pat. No. 6,421,512, the applicant of the present invention proposed an image forming apparatus provided with residual developer uniformizing means (residual toner uniformizing means) in the upstream of toner charging means and the downstream of a transfer portion. The residual toner uniformizing means disperses a pattern of a transfer residual toner image on a photosensitive member, which is carried to the toner charging means from the transfer portion, to unpattern the same. More specifically, the transfer residual toner image pattern is scraped or disturbed by rubbing the surface of the photosensitive member with a rubbing member, whereby the developer is dispersed over the surface of the photosensitive member. The dispersed transfer residual toner is sufficiently charged to the normal polarity by the toner charging means in the next step. Therefore, an effect of preventing the transfer residual toner from being attached on the contact charging member is improved significantly. By providing the residual toner uniformizing means, the generation of a ghost image or the generation of a fogged image due to contamination of the charging member as described above can be suppressed.

However, even in the case in which the toner charging means and the residual toner uniformizing means are provided, a toner (or an extraneous additive) may attach on the photosensitive member. Attachment of a toner is considered to occur as a result of a part of a toner (or an extraneous additive), which adheres to the surface of the photosensitive member due to discharge by the toner charging means, being exposed to discharge of the toner charging means and the contact charging member many times without being attached in the developing means and without being transferred by the transfer means. Such toner attachment corresponds to discharge unevenness in a longitudinal direction of the toner charging means and, in the case in which the toner charging means is constituted by an electroconductive brush or the like, occurs in a shape of sweeping seam of the brush along a rotational direction of the photosensitive member. The attached matter is easily scraped off by a conventional cleaning blade of a type that physically scrapes off the attached matter. However, the attached matter cannot be removed completely by the process of the cleaning-less type. Therefore, if the same photosensitive member is continuously used for a long period time, the attached matter accumulates to make the surface of the photosensitive member streak-like, which affects an image.

Thus, as disclosed in Japanese Patent Application Laid-Open No. 2001-215799, the applicant of the present invention made the toner charging means or the residual toner uniformizing means, or both of them to move in a longitudinal direction of the photosensitive member (a rotary shaft direction of the photosensitive member) such that discharge of the toner charging means does not concentrate on a specific region in the longitudinal direction of the photosensitive member while increasing an opportunity of the residual toner uniformizing means rubbing the photosensitive member, whereby the attached toner can be easily scraped off. In this way, the applicant of the present invention enabled occurrence and progress of attachment of the toner (or an extraneous additive) to be suppressed, preventing the toner from attaching to a specific portion on the photosensitive member. As a result, the toner, which is deposited at the same level, is dispersed substantially uniformly over the photosensitive member without any fluctuation, and a certain level of image quality can be maintained over a long period of time without involving any problem of image quality.

However, even if the toner charging means or the residual toner uniformizing means, or both of them are moved in the longitudinal direction of the photosensitive member, a portion with different state of attachment of the toner may occur periodically in the rotational direction of the photosensitive member according to a rotating period of the photosensitive member or a period for moving the toner charging means or the residual toner uniformizing means. There was a case where an influence of such a portion appeared in a halftone image or the like.

SUMMARY OF THE INVENTION

The present invention has been devised in view of the above-mentioned problems, and it is an object of the present invention to provide an image forming apparatus which can eliminate generation of a periodical attachment pattern of a developer appearing on an image bearing member.

It is another object of the present invention to provide an image forming apparatus that makes it possible not to clarify an attachment pattern or a streak-like attachment of a developer on an image bearing member.

DETAILED DESCRIPTION OF THE PREFERRED EMBODIMENTS

An image forming apparatus and a process cartridge in accordance with the present invention will be hereinafter described more in detail with reference to the accompanying drawings.

First Embodiment

Figure 1:
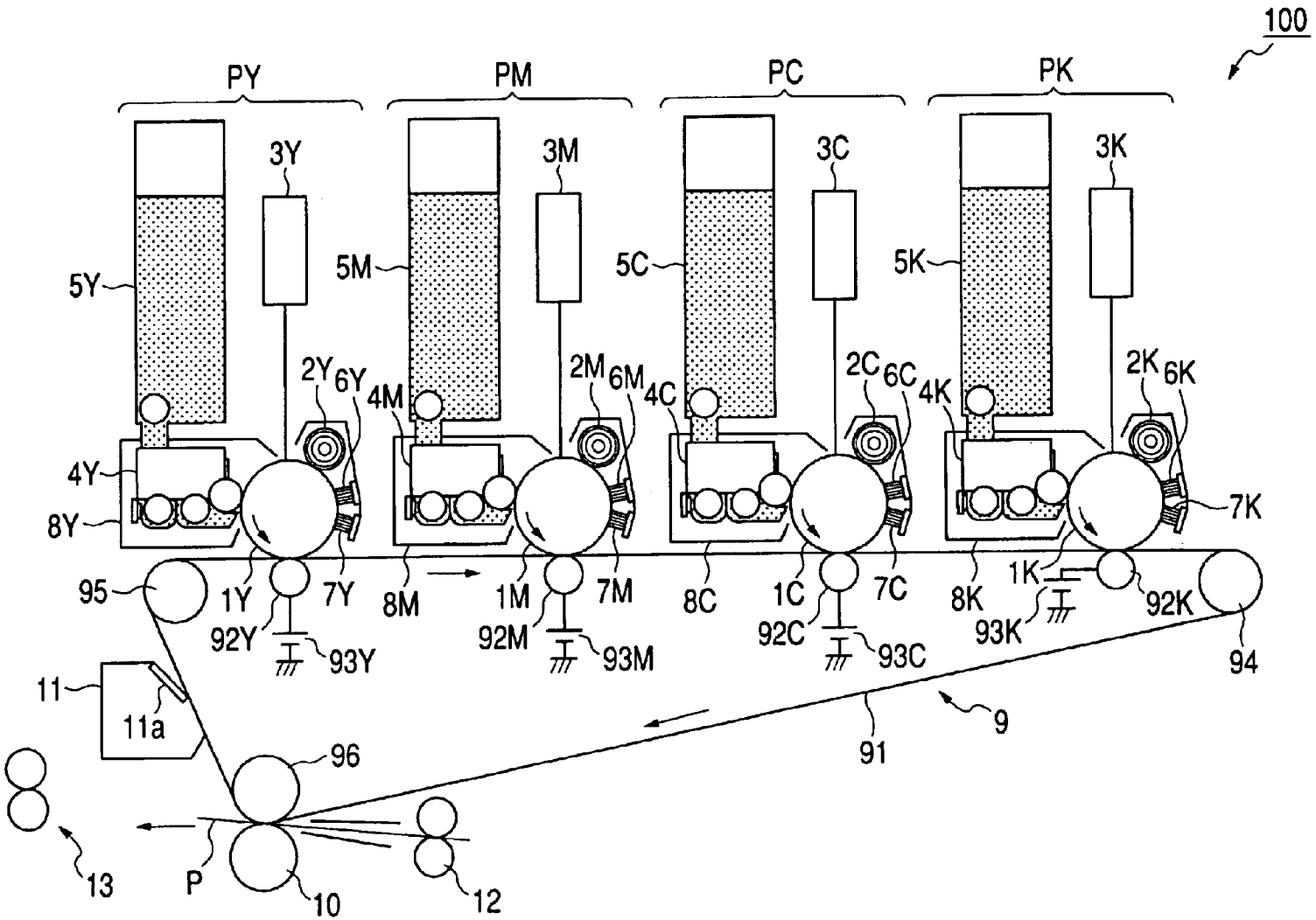
FIG. 1 is a schematic sectional view of an embodiment of an image forming apparatus in accordance with the present invention.

FIG. 1 shows a schematic structure of an embodiment of the image forming apparatus in accordance with the present invention. An image forming apparatus 100 of this embodiment is a color laser printer with a maximum paper passing size of A3, which uses a transfer-system electrophotographic process, a contact charging system, and a reversal development system. The image forming apparatus 100 can form a full-color image on a transferring material such as a sheet, an OHP sheet, or cloth according to image information from an external host apparatus communicatably connected to an image forming apparatus main body (apparatus main body), and outputs the image.

The image forming apparatus 100 has a plurality of process cartridges (process units) 8. The image forming apparatus 100 is of a four-drum system (inline tandem structure) which once multiply transfers a toner image continuously to an intermediate transfer member 91 by the respective process cartridges 8 and then collectively transfers the toner images to a transferring material P to thereby obtain a full-color print image. The four process cartridges 8 are arranged in series in the order of yellow, magenta, cyan, and black in a moving direction of an intermediate transfer belt 91. Note that, although the four process cartridges are used in this embodiment, it is also possible to integrate the four process cartridges to form a single process cartridge.

In this embodiment, image forming portions PY, PM, PC, and PK of the respective color of yellow (Y), magenta (M), cyan (C), and black (K) serving as a plurality of image forming means have an identical structure except that colors of developers to be used are different from each other. Therefore, if specific distinction is not required, attached characters Y, M, C, and K indicating elements of the respective image forming portions will be omitted, and the image forming portions will collectively be described. Note that the image forming portions each include at least an image bearing member, charging means, developing means, and developer charging means. The respective components will be described later.

For example, an overall operation in the case of forming a full-color image of four colors will be described. An image signal subjected to color separation is generated in accordance with a signal from an external host apparatus, which is communicatably connected, to the image forming apparatus 100. In response to the generated image signal, toner images of the respective colors are formed in respective process cartridges 8Y, 8M, 8C, and 8K of the respective image forming portions PY, PM, PC, and PK. The respective process cartridges 8Y, 8M, 8C, and 8K charge electrophotographic photosensitive members (photosensitive drums) 1 serving as image bearing members with charging means 2, scan and expose the uniformly charged surfaces with exposure means 3 to thereby form electrostatic latent images on the photosensitive drums 1, and supply toners serving as developers to these electrostatic latent images with developing means 4 to thereby form toner images. The toner images of the respective colors formed on the respective photosensitive drums 1 are superimposed one after another and transferred on an intermediate transfer belt 91 serving as a moving intermediate transfer member. Then, a full-color toner image formed on the intermediate transfer belt 91 is collectively transferred onto a transferring material P which is conveyed to a secondary transfer portion where the intermediate transfer belt 91 and a secondary transfer roller 10 serving as secondary transfer means are opposed to each other. Subsequently, the transferring material P is conveyed to fixing means 13, and after being subjected to fixing of the toner image here, discharged to the outside of the apparatus.

The respective elements of the image forming apparatus 100 will be described in detail one after another with reference to FIG. 2 as well.

The image forming apparatus 100 has an electrophotographic photosensitive member (photosensitive drum) 1 of a rotary drum type as an image bearing member. In this embodiment, the photosensitive drum 1 is an organic photoconductor (OPC) drum with an external diameter of 50 mm and is driven to rotate in a counterclockwise direction indicated by an arrow in the drawing at a process speed (peripheral speed) of 100 mm/sec around a central supporting shaft. The photosensitive drum 1 has a structure in which three layers, namely, an underlying layer for controlling interference of light to improve an adhesive property of an upper layer, a photocharge generation layer, and a charge transport layer (with a thickness of 20 $\mu$m), are stacked in the stated order from the bottom on a surface of an aluminum cylinder (electroconductive drum base body).

In this embodiment, the image forming apparatus 100 has a charging roller 2 serving as a contact charger as charging means. The photosensitive drum 1 is uniformly charged in a negative polarity by applying a voltage under predetermined conditions to the charging roller 2. The charging roller 2 has a longitudinal length of 320 mm and has a three-layer structure in which a lower layer 2*b*, a middle layer 2*c*, and a surface layer 2*d* are stacked from the bottom on an outer periphery of a core metal 2*a*. The lower layer 2*b* is a foamed sponge layer for reducing charging sound, the middle layer 2*c* is a resistance layer for obtaining a uniform resistance in the entire charging roller 2, and the surface layer 2*d* is a protective layer which is provided for preventing leak from occurring even if there is a defect such as a pinhole on the photosensitive drum 1. In the charging roller 2 of this embodiment, a stainless steel round bar with a diameter of 6 mm is used as the core metal 2*a*, carbon is dispersed in fluorine resin for a surface layer, an external diameter as the roller is 14 mm, and a roller resistance is set to $10^4\Omega$ to $10^7\Omega$.

The charging roller 2 holds both ends of the core metal 2*a* rotatably with a bearing member, respectively, and biases the core metal 2*a* in a direction of the photosensitive drum 1 with a pressing spring to bring it into pressed contact with the surface of the photosensitive drum 1 with a predetermined pressing force. In addition, the charging roller 2 rotates while following the rotation of the photosensitive drum 1. Then, a predetermined oscillating voltage, in which an AC voltage of a predetermined frequency is superimposed on a DC voltage (charging bias voltage Vdc+Vac), is applied to the charging roller 2 from a power supply 20 serving as voltage application means via the core metal 2*a*. The peripheral surface of the rotating photosensitive drum 1 is charged to a predetermined potential. A contact portion of the charging roller 2 and the photosensitive drum 1 is a charging portion "a".

In this embodiment, a charging bias voltage to be applied to the charging roller 2 is an oscillating voltage in which a sine wave AC voltage with a frequency of 1,150 Hz and a peak-to-peak voltage Vpp of 1,400 V is superimposed on a DC voltage of −500 V. The peripheral surface of the photosensitive drum 1 is uniformly charged to −500 V (dark portion potential Vd) through contact with the charging roller 2.

After being uniformly charged to predetermined polarity and potential by the charging roller 2, the photosensitive drum 1 is exposed to imaging exposure light L by imaging exposure means (a color separation/imaging exposure optical system for a color original image, a scan exposure system by laser scan for outputting a laser beam modulated in response to a time-series electrical digital pixel signal of image information, etc.). Consequently, electrostatic latent images of color components corresponding to the respective image forming portions PY, PM, PC, and PK of an objective color image are formed. In this embodiment, a laser beam scanner 3 using a semiconductor laser is used as the exposure means. The laser beam scanner 3 outputs a laser beam modulated in response to an image signal sent from a host apparatus such as an image reading apparatus (not shown) to the image forming apparatus 100 side, and laser-scans and exposes the uniformly charged surface of the rotating photosensitive drum 1 (image exposure). With this laser-scanning exposure, a potential in a part on the surface of the photosensitive drum 1 irradiated by the laser beam L falls, whereby an electrostatic latent image corresponding to scanned and exposed image information is formed on the surface of the rotating photosensitive drum 1. In this embodiment, an exposure part potential V1 is set to −150 V. An irradiating position of the image exposure light L in the photosensitive drum 1 is an exposure part "b".

Subsequently, the electrostatic latent image formed on the photosensitive drum 1 is developed with a toner in the developing device 4 serving as developing means. In this embodiment, the developing device 4 is a two-component contact developing device (two-component magnetic brush developing device). The developing device 4 includes: a developer container (developing device main body) 40; a developing sleeve 41 as a developer carrying member having a magnet roller fixedly arranged therein; a developer regulating blade 42 as a developer regulating member; a two-component developer (developer) 43, which is mainly a mixture of resin toner particles (toner) and magnetic carrier particles (carrier), contained in the developer container 40; and other components.

The developing sleeve 41 is arranged rotatably in the developer container 40 with a part of an external peripheral surface of the sleeve exposed to the outside. The developer regulating blade 42 is opposed to the developing sleeve 41 with a predetermined space. In accordance with the rotation of the developing sleeve 41 in a direction of arrow in the figure, the developer regulating blade 42 forms a developer thin layer on the developing sleeve 41. In this embodiment, the developing sleeve 41 is arranged to be opposed to the photosensitive drum 1 in proximity thereto with a closest distance (S-Dgap) kept at 350 $\mu$m. A portion where the photosensitive drum 1 and the developing sleeve 41 are opposed to each other is a development portion "c".

In addition, in the development portion c, the developing sleeve 41 is driven to rotate in a direction opposite to a rotational direction of the photosensitive drum 1. The developer thin layer on the developing sleeve 41 comes into contact with the surface of the photosensitive drum 1 in the development portion "c" and rubs the photosensitive drum 1 appropriately. A predetermined development bias voltage is applied to the developing sleeve 41 from a power supply (not shown) serving as voltage application means. In this embodiment, the development bias voltage to be applied to the developing sleeve 41 is an oscillating voltage in which an AC voltage (Vac) is superimposed on a DV voltage (Vdc). More specifically, the development bias voltage is an oscillating voltage in which Vac with Vpp of 1,800 V and a frequency of 2,300 Hz is superimposed on Vdc of −350 V.

Accordingly, the toner in the developer 43, which is coated on the rotating developing sleeve 41 as a thin layer and carried to the development portion "c", deposits on the electrostatic latent image, which is formed on the photosensitive drum 1, selectively in response to a field formed by the development bias voltage. Thus, the electrostatic latent image is developed as a toner image. In this embodiment, the toner deposits in an exposure light portion on the photosensitive drum 1, whereby the electrostatic latent image is reversely developed. The developer thin layer on the developing sleeve 41 having passed the development portion "c" is returned to a developer reservoir portion in the developer container 40 in accordance with subsequent rotation of the developing sleeve 41.

In this embodiment, a negatively charged toner with an average particle diameter of 6 $\mu$m was used as a toner, and a magnetic carrier with saturation magnetization of 205 emu/cm$^3$ and an average particle diameter of 35 $\mu$m was used as a carrier. In addition, a mixture of the toner and the carrier mixed at a weight ratio 6:94 was used as a developer. Further, an amount of charging of the toner served for development on the photosensitive drum 1 is −25 $\mu$C/g.

An intermediate transfer unit 9 serving as transfer means is provided so as to be opposed to the respective photosensitive drums 1 of the respective image forming portions PY, PM, PC, and PK. In the intermediate transfer unit 9, an endless intermediate transfer belt 91 serving as an intermediate transfer member is laid over a drive roller 94, a tension roller 95, and a secondary transfer opposed roller 96 with a predetermined tension and moves in a direction of arrow in the figure.

The toner image formed on the photosensitive drum 1 enters a primary transfer nip portion (transfer portion) "d" which is a portion where the photosensitive drum 1 and the intermediate transfer belt 91 are opposed to each other. In the transfer portion "d", a primary transfer roller 92 serving as primary transfer means is in abutment against the back of the intermediate transfer belt 91. A primary transfer bias power supply 93 serving as voltage application means is connected to the primary transfer roller 92 such that a primary transfer bias voltage can be applied to the respective image forming portions PY, PM, PC, and PK, independently.

First, a toner image of yellow, which is formed on the photosensitive drum 1 by the above-mentioned operation, is transferred to the intermediate transfer belt 9 in the image forming portion PY of the first color (yellow). Subsequently, toner images of magenta, cyan, and black are multiply transferred to the intermediate transfer belt 91 from the photosensitive drums 1 corresponding to the respective colors, which have undergone the same process, in the respective image forming portions PM, PC, and PK.

In this embodiment, taking into account a transfer efficiency with respect to the toner transferred to the exposure part (exposure part potential V1: −150 V), a voltage of +350 V was applied for all the first to fourth colors as the primary transfer bias voltage. A full-color image of four colors formed on the intermediate transfer belt 91 is then supplied from transferring material feeding means (not shown) by the secondary transfer roller 10 serving as secondary transfer means and is collectively transferred to a transferring material P conveyed from a sheet feed roller 12 serving as conveying means at a predetermined timing.

The transferring material P having the toner image transferred thereon is then conveyed to a roller fixing device 13 serving as fixing means. The toner image is fused and fixed on the transferring material P by heat and pressure in the roller fixing device 13. Thereafter, the transferring material P is discharged to the outside of the apparatus, and a color print image is obtained.

In addition, a secondary transfer residual toner remaining on the intermediate transfer belt 91 is cleaned by a cleaning blade 11*a* serving as cleaning means provided in an intermediate transfer belt cleaner 11 and is prepared for the next image forming process.

As a material of the intermediate transfer belt 91, in order to improve registration in the image forming portions PY, PM, PC, and PK of the respective colors, an elastic material is not desirable. A rubber belt with a resin or metal core, or a belt composed of resin and rubber is desirable. In this embodiment, a resin belt with carbon dispersed in polyimide (PI) and a volume resistance thereof controlled to the order of $10^8$ Ω·cm was used. A thickness, a longitudinal length, and a total peripheral length thereof are 80 μm, 320 mm, and 900 mm, respectively.

In addition, as the primary transfer roller 92, a roller composed of electroconductive sponge was used. A resistance thereof was set to $10^6$Ω or less, and an external diameter and a longitudinal length thereof were set to 16 mm and 315 mm, respectively.

Moreover, provided in the respective image forming portions PY, PM, PC, and PK are a second toner charging brush 6 serving as second developer charging means, which is located on the downstream side with respect to a moving direction of the photosensitive drum, and a first toner charging brush 7 serving as first developer charging means, which is located on the upstream side with respect to the moving direction of the photosensitive drum. The second toner charging brush 6 and the first toner charging brush 7 are in abutment against the photosensitive drum 1, respectively. In this embodiment, a brush member composed of electroconductive fiber was used for both the second toner charging brush 6 and the first toner charging brush 7. More specifically, the second toner charging brush 6 is an oblong electrode plate 62 provided with a brush portion 61. In addition, the first toner charging brush 7 is an electrode plate 72 provided with a brush portion 71 in the same manner. Further, the brush portions 61 and 71 are disposed in abutment against the surface of the photosensitive drum 1.

The respective brush portions 61 and 71 of the second toner charging brush 6 and the first toner charging brush 7 are composed of a material with a resistance value thereof controlled by containing carbon or metal powder in fiber made of rayon, acrylic, or polyester, for example. The brush portions 61 and 71 preferably have a thickness of 30 deniers or less and a density of 1 to 500,000 piles/inch$^2$ or more such that the brush portions 61 and 71 can come into contact with the surface of the photosensitive drum 1 and the transfer residual toner uniformly. In this embodiment, in both the brush portions 61 and 71, the thickness was set to 6 deniers, the density was set to 100,000 piles/inch$^2$, a length of pile was set to 5 mm, and a volume resistance was set to $6\times10^3$ Ω·cm. Then, the second toner charging brush 6 and the first toner charging brush 7 were brought into abutment against the photosensitive drum 1 such that the brush portions 61 and 71 had a penetration amount of 1 mm with respect to the surface of the photosensitive drum 1. An abutment nip width thereof with respect to the photosensitive drum 1 was set to 5 mm.

Figure 2:
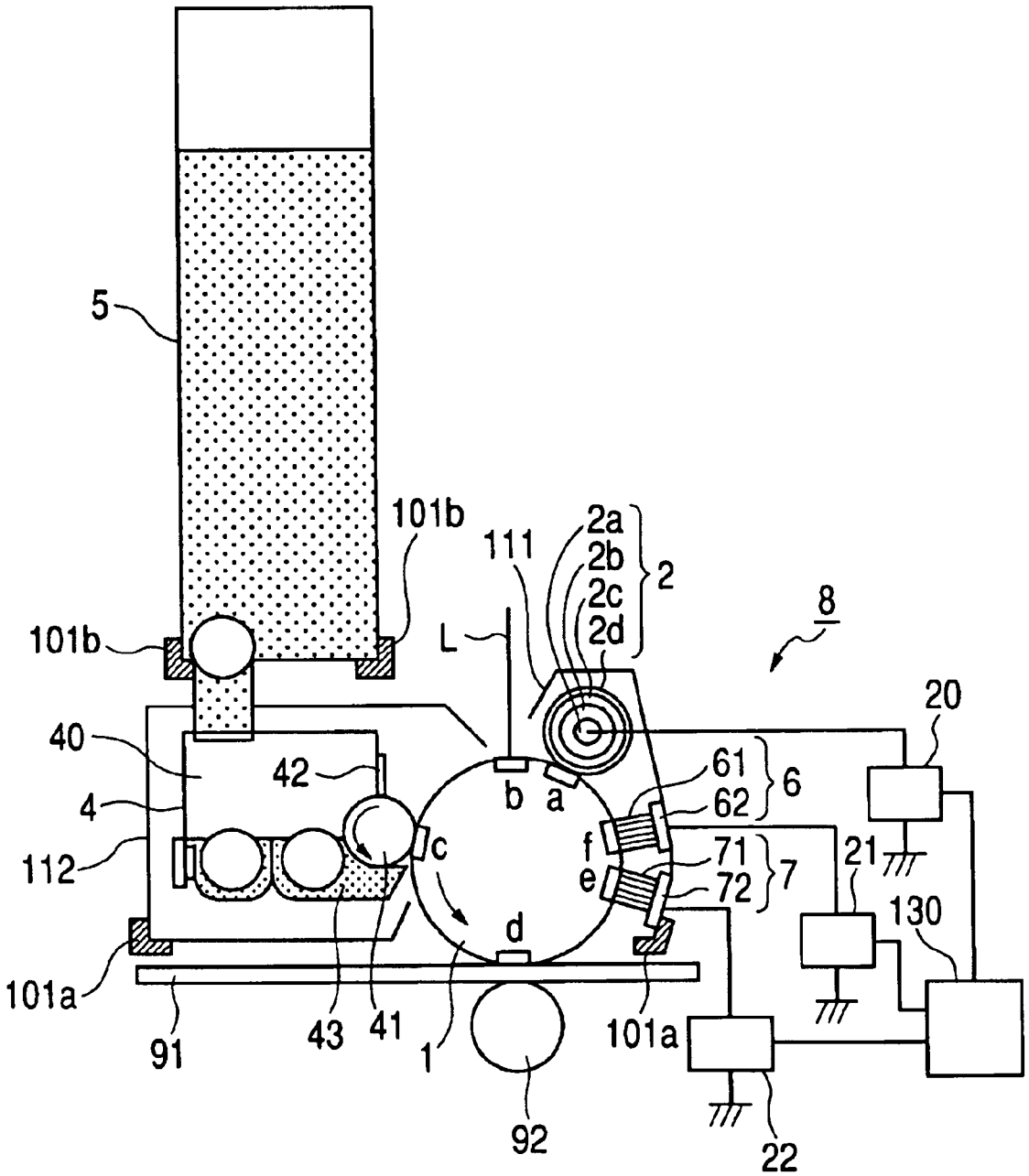
FIG. 2 is a schematic sectional view of a process cartridge which is mounted to the image forming apparatus of FIG. 1.

As shown in FIG. 2, the first toner charging brush 7 and the second toner charging brush 6 are located further on the downstream side in the rotational direction of the photosensitive drum 1 than the transfer portion "d" and further on the upstream side than the charging portion "a". The first toner charging brush 7 and the second toner charging brush 6 are arranged in this order from the upstream in the rotational direction of the photosensitive drum 1. Further, the first toner charging brush 7 forms a contact portion "e" with the photosensitive drum 1 and the second toner charging brush 6 forms a contact portion "f" with the photosensitive drum 1.

As described above, the first toner charging brush 7 disperses a pattern of a transfer residual toner image on the photosensitive drum 1, which is carried from a transfer portion to the second toner charging brush 6, over a surface of a photosensitive member to unpattern the same. Moreover, when an oscillating voltage, in which an AC voltage is superimposed on a DC voltage, is applied to the first toner charging brush 7, a function of retaining the transfer residual toner improves temporarily to ease fluctuation of an amount of the transfer residual toner to be sent to the second toner charging brush 6. In this embodiment, a bias in which a sine wave AC voltage with a frequency of 1,150 Hz and a peak-to-peak voltage Vpp of 400 V is superimposed on a DC voltage of +250 V was applied by the power supply 22.

A toner carried to the second toner charging brush 6 from the first toner charging brush 7 is applied with a voltage, which has the negative polarity being a normal polarity of the toner and exceeds a discharge initiating voltage between the second toner charging brush 6 and the photosensitive drum 1, from a power supply 21 by the second toner charging brush 6, whereby a charge of the negative polarity is given to the toner. In this embodiment, a DC bias of −700 V or more was applied to the toner.

Figure 3:
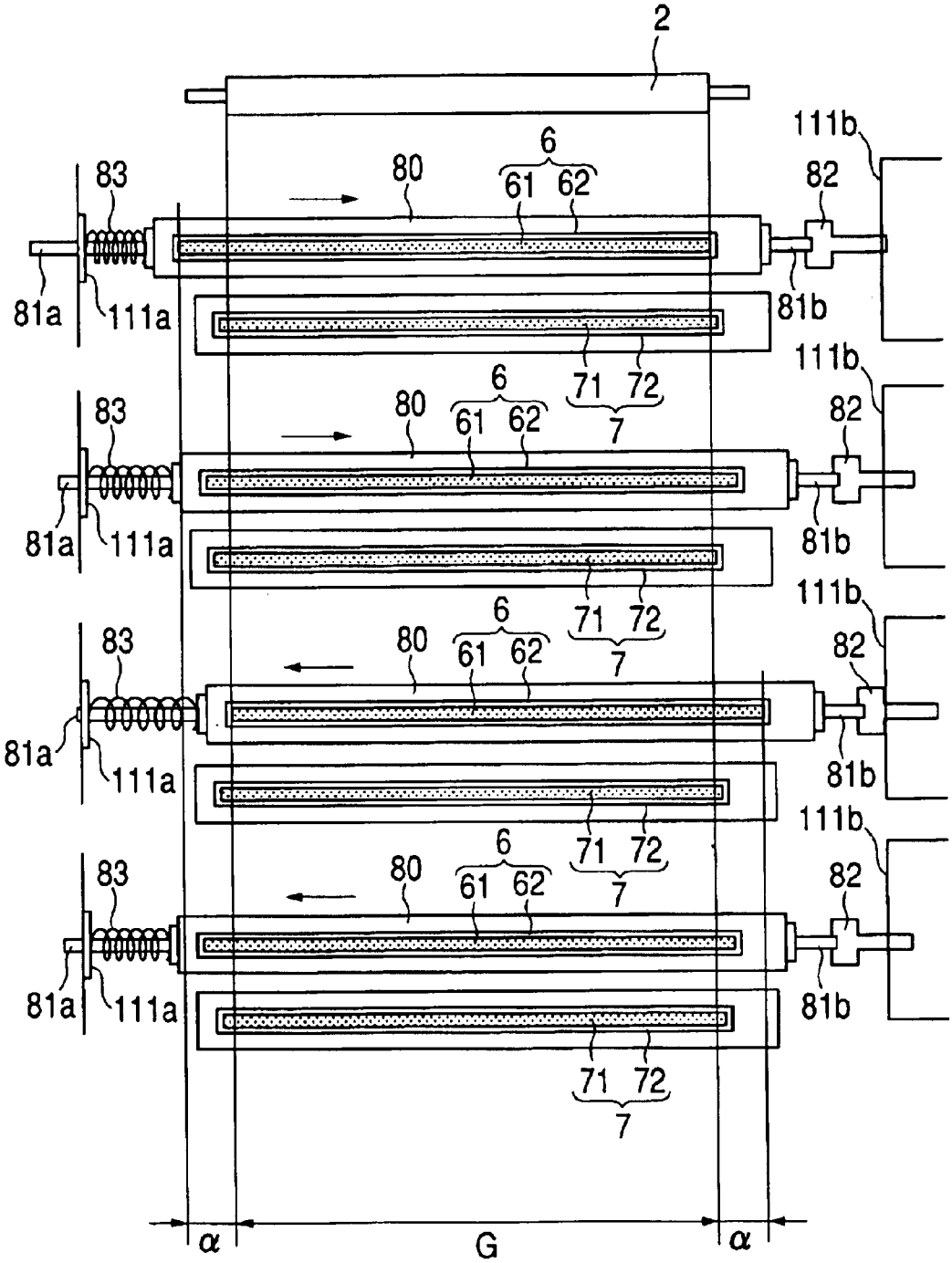
FIG. 3 is a schematic view showing an embodiment of a driving form of toner charging means.

Moreover, in this embodiment, as shown in FIG. 3, the second toner charging brush 6 is reciprocated in a longitudinal direction of the photosensitive drum 1 (a direction substantially perpendicular to a moving direction of the surface of the photosensitive drum 1) in response to the rotation of the photosensitive drum 1. The second toner charging brush 6 is arranged substantially in parallel with the longitudinal direction of the photosensitive drum 1 and is fixed to a base 80 serving as a supporting member reciprocating by a fixed amount with respect to the longitudinal direction. A rotation drive force, which is transmitted to the photosensitive drum 1 by a drive motor (not shown) of the image forming apparatus 100, is transmitted to the base 80 via a gear train, and the base 80 is driven so as to reciprocate by a fixed amount with respect to the longitudinal direction. Consequently, the surface of the photosensitive drum 1 is rubbed by the brush portion 61 of the second toner charging brush 6.

Further explanation is given here. Support pins 81*a* and 81*b* serving as supporting portions extend from both ends in the longitudinal direction of the base 80. One support pin 81*a* is inserted through a through-hole of a support wall 111*a* provided in a charging unit frame body 111 and supported slidably. The other support pin 81*b* is fixedly supported by drive force transmission means 82 which transmits a drive force, which is transmitted from drive means (not shown) of the image forming apparatus main body, to the base 80. The drive force transmission means 82 is coupled to a drive force transmission unit 111*b* which, for example, changes the rotation drive force transmitted to the photosensitive drum 1 to a reciprocation drive force by use of a cam gear, which is provided with a gear portion and a cam groove, a projection, which slides along the cam groove to move in the longitudinal direction of the photosensitive drum 1, and the like. In addition, a return spring 83 is provided at one end in the longitudinal direction of the base 80. The base 80 is reciprocated by a fixed amount with a predetermined moving width (amplitude $\alpha$) in the longitudinal direction.

Note that both the ends of the second toner charging brush 6 are configured so as not to enter the inside of an effective charting region G corresponding to a contact region of the charging roller 2 and the photosensitive drum 1. Here, the ends of the second toner charging brush 6 indicate the ends of the brush portion 61 that charges the toner on the photosensitive drum. That is, the effective charging region where the charging roller charges the photosensitive drum is located further inside than a region of the photosensitive drum where the second toner charging brush is capable of charging the toner. Consequently, the toner not charged by the second toner charging brush is prevented from reaching the charging roller to deposit thereon.

In this embodiment, a moving width of the second toner charging brush 6 was set to 5 mm (amplitude $\alpha$=2.5 mm).

The voltage application means such as the power supplies 20, 21, and 22 provided in the image forming apparatus 100 are controlled by a control circuit 130 serving as control means for collectively controlling operations performed in the image forming apparatus main body.

Note that, in this embodiment, the photosensitive drum 1, the charging roller 2, the developing device 4, the first toner charging brush 7, the second toner charging brush 6, and the like are integrally formed as a cartridge by the charging unit frame body 111 and a development frame body 112 to constitute a process cartridge (process unit) 8. The process cartridge 8 is detachably mounted via mounting means 101*a* provided in the image forming apparatus main body. In addition, in a state in which the process cartridge 8 is mounted to the image forming apparatus main body, drive means (not shown) provided in the image forming apparatus main body and drive force transmission means on the process cartridge 8 side are connected to each other to bring the photosensitive drum 1, the developing device 4, the charging roller 2, and the like into a drivable state. Moreover, in a state in which the process cartridge 8 is mounted to the image forming apparatus main body, various voltage application means, such as the power supplies 20, 21, and 22, which apply a bias to the charging roller 2, the second toner charging brush 6, and the first toner charging brush 7, and a power supply (not shown), which applies a bias to the developing sleeve 41, are electrically connected with the objects via contacts which are provided on the process cartridge 8 side and the image forming apparatus main body side, respectively. A process cartridge constituted to be detachably mountable to an image forming apparatus is not limited to this embodiment but may be one provided with at least the photosensitive drum 1, the charging roller 2, and the second toner charging brush 6.

On the other hand, a toner supply unit (developer supply container) 5, which is connected to the developing device 4 and supplies toner, is detachably mounted to the developing device 4 and the image forming apparatus main body via mounting means 101*b*.

Actions of the second toner charging brush 6 according to this embodiment will be hereinafter described in detail.

As described in the related background art section, in the cleaning-less system, attachment (or fusion bond) of toner or an extraneous additive on the photosensitive drum 1 is considered to occur by transfer residual toner being continuously exposed to discharge from the second toner charging brush 6 or the charging roller 2. In general, a potential on the photosensitive drum 1 is easily uniformized in a high humidity environment in which a relaxation action by moisture is large. To the contrary, since a potential is hardly uniformized in a low humidity environment, a discharge amount tends to increase. Alternatively, a discharge amount may be controlled so as to increase in the low humidity environment in order to uniformize a potential. Thus, attachment of toner easily occurs in the low humidity environment.

In the low humidity environment with a state in which the second toner charging brush 6 is stationary, slight attachment of toner occurs by subjecting the photosensitive drum 1 in an initial stage of use to discharge for about ten rounds. This tendency is substantially the same in a range of a process speed (peripheral speed of the photosensitive drum 1) of 50 to 200 mm/s. In addition, there is a tendency in which progress of the attachment is quicker in an earlier stage and substantially stops when the growth has reached a certain degree.

A state of dispersion of the attachment is often fixed in the initial stage when the attachment occurs on the photosensitive drum 1. A state of dispersion of the toner existing on the photosensitive drum 1 at the time when it enters the charging portion "a" or the contact portion "f" generally corresponds to the state of dispersion of the attachment. As a result, a discharge state easily becomes non-uniform, and a rubbing trace of the second toner charging brush 6 (i.e., sweeping trace of the brush) affecting a dispersion state of the toner on the photosensitive drum 1 in the charging portion "a" is most likely to appear as an attachment pattern on the photosensitive drum 1. Similarly, a rubbing trace of the first toner charging brush 7 is likely to appear as the attachment pattern. In this embodiment, since the second toner charging brush 6 is reciprocated in the longitudinal direction of the photosensitive drum 1, the rubbing trace grows as if it is dispersed. Thus, slight toner attachment is attained without fluctuation in dispersion.

Figure 4:
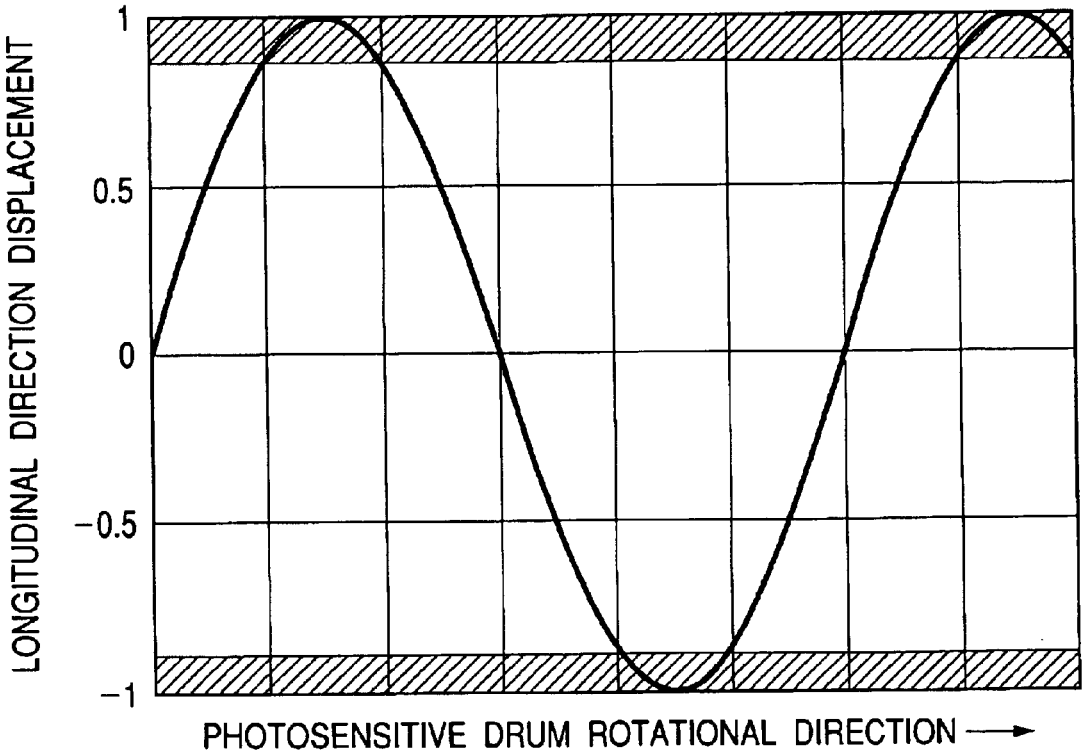
FIG. 4 is a graph for explaining fluctuation in a relative position of the toner charging means with respect to a surface of a photosensitive drum.

The reciprocation of the second toner charging brush 6 of this embodiment will be described in detail. In this embodiment, relative positional fluctuation of the second toner charging brush 6 with respect to the surface of the photosensitive drum 1 reciprocates the second toner charging brush 6 generally in a sine wave shape substantially vertical in the rotational direction of the photosensitive drum 1 as shown in FIG. 4. Note that the relative positional displacement represented by the vertical axis in FIG. 4 is standardized with amplitude set to be one. The horizontal axis in FIG. 4 indicates a rotational movement distance of the photosensitive drum 1.

In the case in which the reciprocation of the second toner charging brush 6 is extremely slow, the second toner charging brush 6 is in a state in which it is substantially stationary with respect to the photosensitive drum 1 in the vicinity of peak positions of the amplitude indicated by shades in FIG. 4. As such a semi-stationary state lasts longer, it is possible that the same attachment as in the stationary state occurs.

An attachment dispersion effect obtained by the reciprocation of the second toner charging brush 6 in this embodiment was confirmed as described below.

When the number of rotations of the photosensitive drum 1 per a unit time is assumed to be "a" and the number of times of reciprocation of the second toner charging brush 6 per the unit time is assumed to be "b", a ratio of the number of rotations of the photosensitive drum 1 and the number of times of reciprocation of the second toner charging brush 6 per a charging time is R=b/a. The ratio R was found and was then changed in the range of 1/100 to 1/5 to observe attachment which occurred on the brand-new photosensitive drum 1 under a low humidity environment (10° C., 15% Rh). Note that "a" is referred to as a frequency of the photosensitive drum 1, "b" is referred to as a frequency of the second toner charging brush, and R is referred to as a ratio of frequencies. Here, several methods are possible as a method of measuring the frequencies "a" and "b". For example, the frequencies "a" and "b" can be found according to a peripheral length and a rotation speed of the photosensitive drum 1, a time required for one reciprocation of the second toner charging brush 6, or the like. In this embodiment, the observation was performed in a state in which the first toner charging brush 7 was removed in order to make attachment conditions strict. As a result, as the ratio of frequencies R became smaller than 1/25 to 1/30, progress of attachment along the circumferential direction of the photosensitive drum 1 tended to be conspicuous. When the ratio of frequencies R was 1/60 or smaller, an attachment state was the same as a state in which the second toner charging brush 6 was stationary. In the range in which the ratio of frequencies R was 1/5 to 1/25, the progress of the attachment along the circumferential direction of the photosensitive drum 1 was never conspicuous, and the toner attached substantially uniformly. From this result, it is seen that the ratio of frequencies R of 1/25 or more is required in order to obtain the attachment dispersion effect according to the reciprocation of the second toner charging brush 6.

In addition, in the state in which the first toner charging brush 7 was removed as in the above description, the ratio of frequencies R was changed in the range of 1.5 to 3 to observe attachment which occurred on the brand-new photosensitive drum 1 under the low humidity environment (10° C., 15% Rh). In this range, there was no significant difference in the attachment state other than at a specific ratio of frequencies that will be described later. In accordance with slight increase in the ratio of frequencies R, the attachment dispersion effect and scraping-off effect of attachment tended to improve. However, since mechanical load or the like of a mechanism for reciprocating the second toner charging brush 6 increases as the ratio of frequencies R is increased, there is no advantage in increasing the ratio of frequencies R more than necessary. In this embodiment, it is desirable that the ratio of frequencies is 3 or lower in terms of durability of the brush portion 61 of the electroconductive brush used as the second toner charging brush 6.

The above-mentioned result was substantially the same in the range in which the process speed was 50 to 200 mm/s and the moving width of the second toner charging brush 6 was 3 to 15 mm (amplitude $\alpha$=1.5 to 7.5 mm).

As described above, the attachment dispersion effect is effective in the range in which the ratio of frequencies R is 1/25 to 3. However, the inventors found that a attachment pattern of a period which is integer times the rotation of the photosensitive drum 1 is generated at a specific ratio of frequencies. This specific ratio of frequencies will be hereinafter described in detail.

First, in the case in which the ratio of frequencies R is an integer (1, 2, or 3), a position where the second toner charging brush 6 and the photosensitive drum 1 are contact with each other does not change even if the photosensitive drum 1 rotates once. Thus, the rubbing trace of the second toner charging brush 6 appears in the same manner as in the case in which the second toner charging brush 6 is made stationary, and the attachment dispersion effect is not shown at all.

Figure 5:
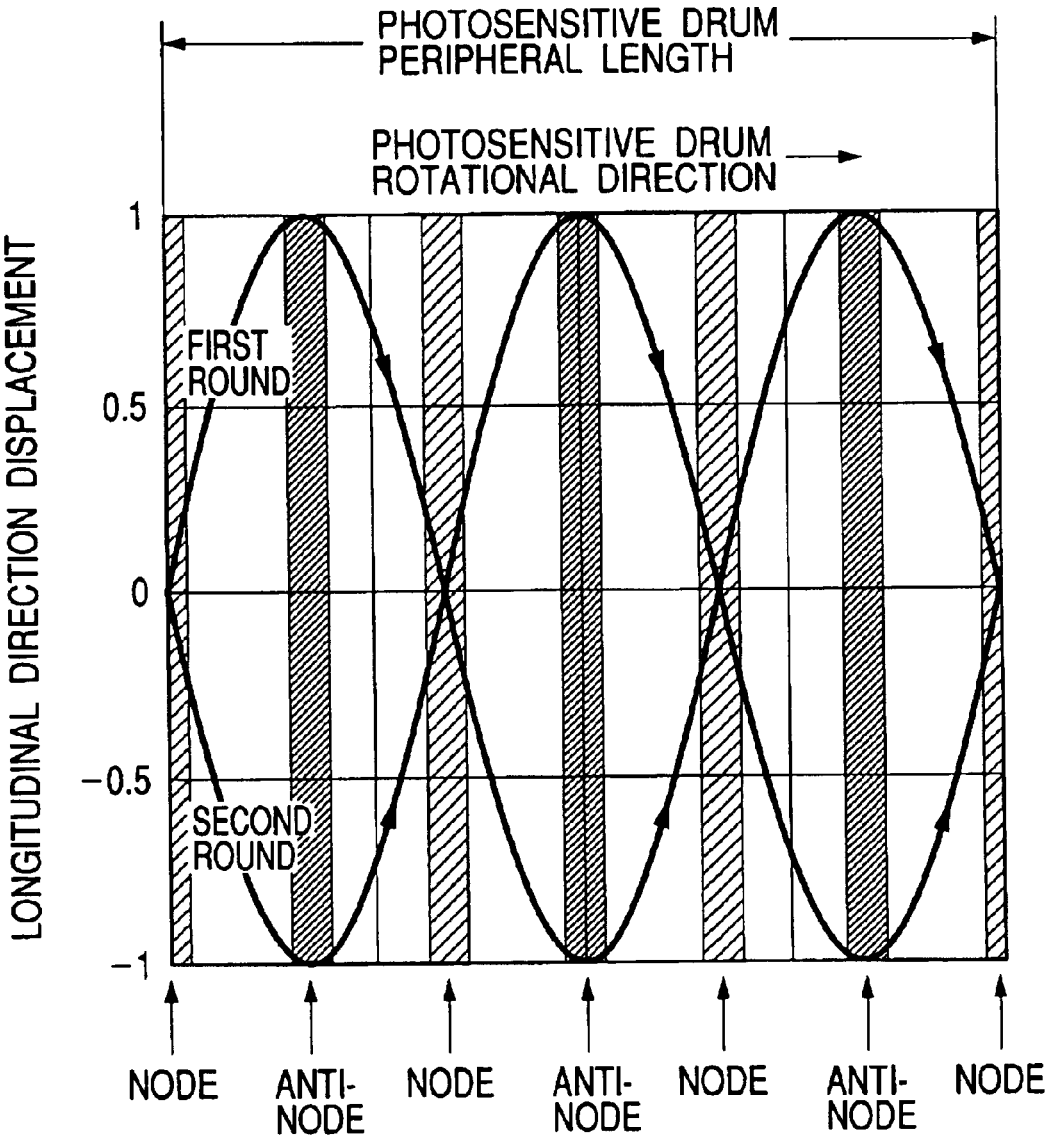
FIG. 5 is a graph for explaining an example of a reciprocation period of the toner charging means with respect to a rotation period of the photosensitive drum.

Next, illustrating a case of R=1.5(3/2) in FIG. 5, a case in which the ratio of frequencies R is a half-integer (0.5, 1.5, or 2.5) will be described. The vertical axis in FIG. 5 indicates a relative positional displacement amount in the longitudinal direction of the photosensitive drum 1 in the second toner charging brush 6. The relative positional displacement amount is standardized with amplitude set to one as in FIG. 4. The horizontal axis of FIG. indicates a length (peripheral length) for one round of the photosensitive drum 1. FIG. 5 as a whole schematically indicates the surface of the photosensitive drum 1.

As shown in FIG. 5, a relative position in the second round of the photosensitive drum 1 of the second toner charging brush 6 is in an antiphase with respect to a relative position in the first round thereof. Thus, parts corresponding to "node" and "anti-node" of a resonant waveform appear. In the part of "anti-node", since a moving speed in the longitudinal direction of the second toner charging brush 6 is small, the attachment dispersion effect is small, and attachment easily progresses along the circumference direction of the photosensitive drum 1. In the part of "node", since the moving speed in the longitudinal direction of the second toner charging brush 6 is large, the attachment dispersion effect is large, and attachment hardly progresses. This difference in the attachment state becomes more conspicuous as the durability of the photosensitive drum 1 increases. As shown in FIG. 5, in the case of R=1.5 (3/2), a attachment pattern at an interval equivalent to 1/3 of the peripheral length of the photosensitive drum 1 was generated and actualized in a halftone image or the like in some cases. Similarly, in the case of R=0.5 (1/2), an attachment pattern of the same period as the photosensitive drum 1 is generated. In addition, in the case of R=2.5 (5/2), an attachment pattern of an interval equivalent to 1/5 of the peripheral length of the photosensitive drum 1 is generated.

Figure 6:
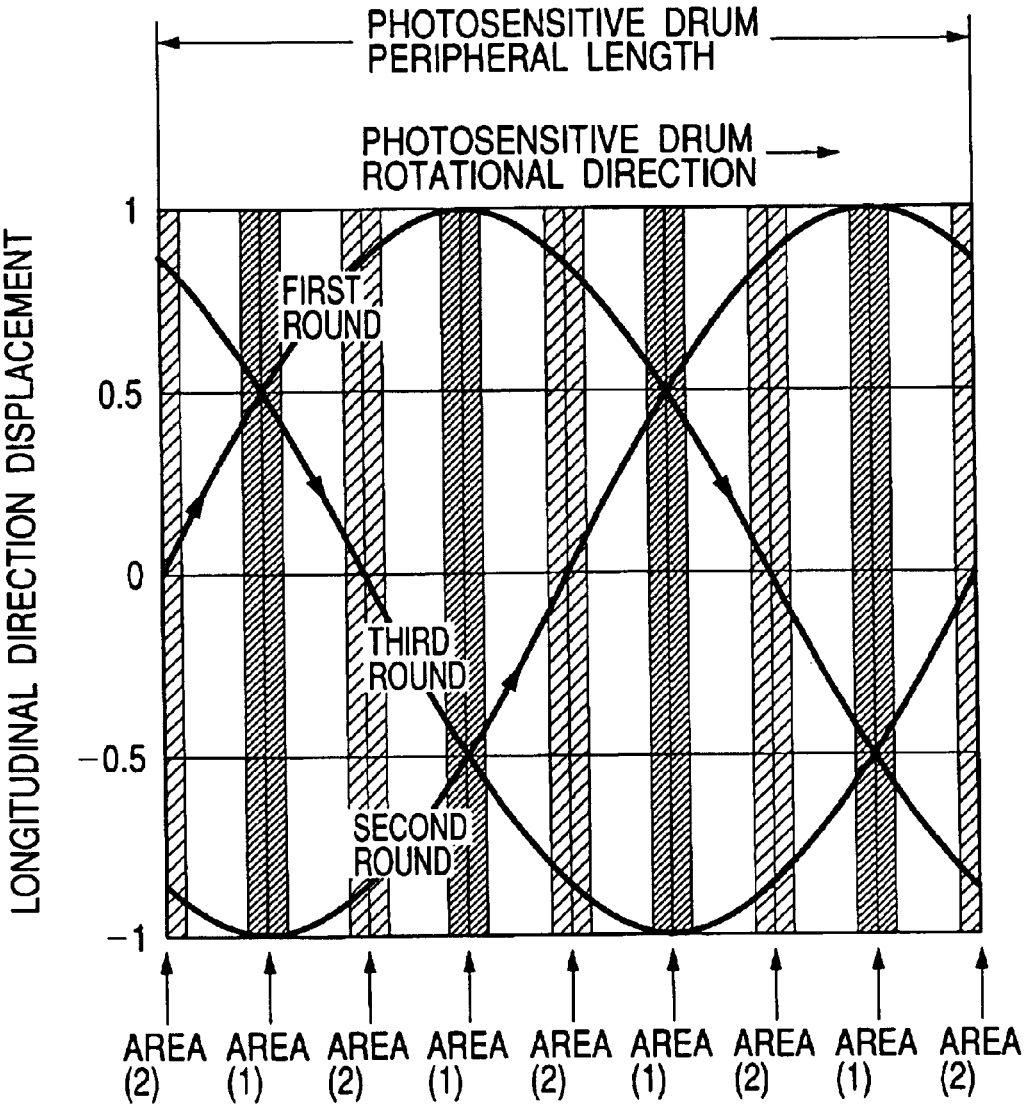
FIG. 6 is a graph for explaining another example of the reciprocation period of the toner charging means with respect to the rotation period of the photosensitive drum.

Next, a case of R=2/3 is illustrated in FIG. 6 and described. As in FIG. 4, the vertical axis in FIG. 6 indicates a relative positional displacement amount of the second toner charging brush 6. Naturally, this relative positional displacement amount returns to its original position when the photosensitive drum 1 rotates three times.

An area (1) in FIG. 6 is a part where a round with relatively large longitudinal movement of the second toner charging brush 6 overlaps twice and a round with small longitudinal movement overlaps once. Since the two rounds with large longitudinal movement move oppositely with respect to the longitudinal direction, the attachment dispersion effect in the part of this area (1) is large, and attachment hardly progresses. An area (2) in FIG. 6 is a part where a round with relatively small longitudinal movement of the second toner charging brush 6 overlaps twice and a round with large longitudinal movement overlaps once. The part of the area (2) has a slightly smaller attachment dispersion effect compared with the part of the area (1). As in the case of a half-integer, the difference of the attachment state becomes more conspicuous as durability of the photosensitive drum 1 increases. In the case of R=⅔, an attachment pattern of an interval equivalent to ¼ of the peripheral length of the photosensitive drum 1 is generated.

Here, the above-mentioned cases are generalized with R=m/n (m and n are integers). Then, in the case of n≧3, an attachment pattern of an interval equivalent to ½m of the peripheral length of the photosensitive drum 1 is generated. In the case of n=2, an attachment pattern of an interval equivalent to 1/m of the peripheral length of the photosensitive drum 1 is generated. In the case in which R is an integer (n=1), twisted streak-like attachment occurs.

From the above description, it is seen that an interval of an attachment pattern decreases as m increases. As the interval decreases, the difference of an attachment state with an adjacent part is eliminated, and practically, a periodic pattern becomes dim. Thus, when m is a certain numerical value or more, the attachment pattern of a period, which is integer times, the rotation of the photosensitive drum 1 disappears.

In addition, the above "n" is a parameter indicating with how many rounds of the photosensitive drum 1 the relative position of the photosensitive drum 1 and the second toner charging brush 6 returns to the original position. This indicates that, during the "n" rounds, the second toner charging brush 6 rubs different positions on the photosensitive drum 1. Thus, naturally, the attachment dispersion effect increases as "n" becomes larger, and an attachment pattern is hardly generated.

Combinations of "m" and "n" to be various rational numbers R=m/n in the application range of this embodiment 1/25≦R≦3 were checked. As a result, it was found that, in the case in which at least one of "m" and "n" is larger than 5, practically, the attachment pattern of a period which is integer times the rotation of the photosensitive drum 1 is not actualized.

Judging from the above, in the case in which the ratio of frequencies R is a rational number in the range of 1/25≦R≦3 represented by m/n (m and n are integers), assuming that the case in which 'both "m" and "n" are integers equal to or smaller than 5' is an exclusion condition 1, in order to prevent the attachment pattern of a period of integer times from being generated, it is necessary to set the ratio of frequencies R avoiding this exclusion condition 1 (i.e., "m" and "n" are set such that both of them are not integers equal to or smaller than 5, in other words, such that at least one of them is an integer larger than 5).

As in this embodiment, in a constitution for driving reciprocation of the second toner charging brush 6 by transmitting a rotation drive force of the photosensitive drum 1 via a gear train, the ratio of frequencies R of the reciprocation of the second toner charging brush 6 with respect to a frequency of the rotation of the photosensitive drum 1 depends upon a gear ratio of this gear train. If a simple drive force transmission route with a small number of gear trains is constituted, it is possible that the ratio of frequencies R is against the exclusion condition 1 (rational number constituted by an integer equal to or smaller than 5). In order to avoid this, it is sufficient to adopt a gear ratio such that the ratio of frequencies R is a rational number including an integer larger than 5 (e.g., R=4/7, 6/5, etc.). In this embodiment, the ratio of frequencies R of the second toner charging brush 6 was set to 5/9.

Next, the ratio of frequencies R in the vicinity of the exclusion condition 1 was checked in detail. The driving of the photosensitive drum 1 and the driving of the reciprocation of the second toner charging brush 6 were separately performed and, in a state in which the first toner charging brush 7 was removed, the reciprocation of the second toner charging brush 6 was changes so as to be slightly different from the ratio of frequencies R of the exclusion condition 1 to observe the surface of the photosensitive drum 1. Then, attachment occurred on the brand-new photosensitive drum 1. In particular, the attachment was conspicuous under the low humidity environment (10°, 15% Rh).

Thus, it was checked what the ratio of frequencies R should be. In the case in which the ratio of frequencies R of the exclusion condition 1 was an integer, streak-like attachment occurred when the ratio of frequencies R was within ±3% with respect to the exclusion condition 1 . The streak-like attachment disappeared when R is ±4% or more with respect to the exclusion condition 1 . This corresponds to a state in which a period of the second toner charging brush 6 causes fluctuation of ±1/25 period or more for one round of the photosensitive drum 1 with respect to a period of the photosensitive drum 1. If the ratio of frequencies R is 1/25 or more with respect to the case in which the second toner charging brush 6 is made stationary, this corresponds to the above-mentioned case in which attachment did not occur. In addition, in the case in which the ratio of frequencies R of the exclusion condition 1 is other than an integer, the attachment pattern disappears even if the ratio of frequencies R only has a difference of ±1% with respect to the exclusion condition 1 . Thus, if the ratio of frequencies R of the exclusion condition 1 is an integer, a part of 0.96 R or more and 1.04 R or less is added as a second exclusion condition anew. If the ratio of frequencies R of the exclusion condition 1 is a non-integer, a range of 0.99 R or more or 1.01 R or less is added as a second exclusion condition anew. Consequently, it becomes possible to improve the effect of attachment dispersion.

The exclusion condition 2 mentioned above indicates that the attachment dispersion effect is more conspicuous as fluctuation of a phase of the second toner charging brush 6 with respect to the photosensitive drum 1 becomes larger.

As described above, according to this embodiment, the second toner charging brush 6 is reciprocated with respect to the longitudinal direction of the photosensitive drum 1. In addition, the case in which the ratio of frequencies R of reciprocation of the second toner charging brush 6 with respect to a rotation period of the photosensitive drum 1 is "a rational number satisfying the condition R=m/n (m and n are integers of 5 or less)" in the range of 1/25≦R≦3 is set as the exclusion condition 1, and R is set avoiding the exclusion condition 1. Consequently, it is possible to prevent an attachment pattern of the photosensitive drum 1 from being actualized.

In addition, the case in which "R is in the range of 0.96 R or more and 1.04 R or less if R of the exclusion condition 1 is an integer, and R is in the range of 0.99 R or more or 1.01 R or less if R of the exclusion condition 1 is a non-integer" is set as an exclusion condition 2, and R is set avoiding the exclusion condition 2. Consequently, it is possible to prevent streak-like attachment of the photosensitive drum 1 from being actualized.

Note that in the above-mentioned embodiment, a transfer member (member to be transferred) to which toners are transferred from the respective image forming portions PY, PM, PC, and PK is described as an intermediate transfer member. However, the present invention is not limited to this. As it is well known for those skilled in the art, there is an image forming apparatus which has a transferring material carrying member, which carries a transferring material such as a recording sheet and conveys the transferring material to a plurality of image forming portions sequentially, instead of an intermediate transfer member, superimposes and transfers toner images sequentially from the respective image forming portions on the transferring material on this transferring material carrying member, thereafter separates the transferring material from the transferring material carrying member and conveys it to fixing means, and fixes unfixed toner images in the fixing means to obtain a color image. The present invention can be equally applied to such an image forming apparatus as well.

In addition, in the above-mentioned embodiment, the second toner charging brush 6 and the first toner charging brush 7 are fixed brush-like members. However, these brushes may be members of any form such as a brush rotary member, an elastic roller member, or a sheet-like member.

Second Embodiment

Next, another embodiment of the image forming apparatus in accordance with the present invention will be described. The basic structure of the image forming apparatus of this embodiment is the same as that in the first embodiment, and the structures of the second toner charging brush 6 and the first toner charging brush 7 are changed. Therefore, components having the identical structure and function as those in the first embodiment are denoted by the identical reference numerals, and a detailed description of the components will be omitted.

Figure 7:
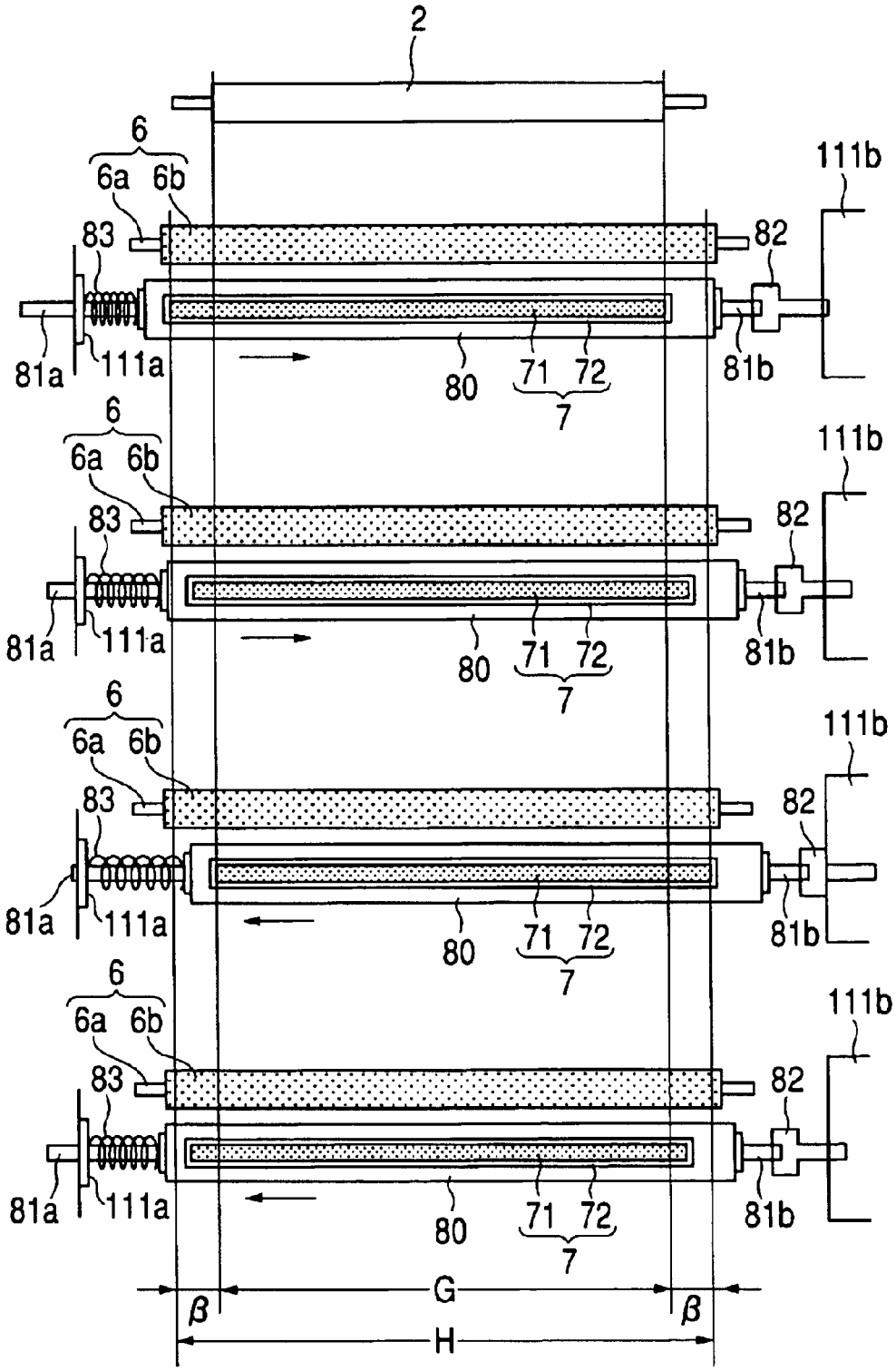
FIG. 7 is a schematic view showing an embodiment of a driving form of residual toner uniformizing means.

In this embodiment, as shown in FIG. 7, the first toner charging brush 7 is reciprocated in the longitudinal direction of the photosensitive drum 1 in response to the rotation of the photosensitive drum 1 instead of the second toner charging brush 6. The first toner charging brush 7 is identical with the brush member used in the first embodiment.

The second toner charging brush 6 was constituted as an electroconductive brush roller with an electroconductive brush 6*b* wound around a core metal 6*a* and was fixed in a position in the longitudinal direction with respect to the photosensitive drum 1. In the brush portion 6*b*, a thickness was set to 6 deniers, a density was set to 100,000 piles/inch$^2$, a length of pile was set to 5 mm, and a volume resistance of the brush was set to $6\times10^3$ Ω·cm. The brush portion 6*b* was brought into abutment against the surface of the photosensitive drum 1 so as to have a penetration amount of 1 mm. An abutment nip portion between the brush portion 6*b* and the photosensitive drum 1 was set to 4 mm.

In this embodiment, a reciprocation mechanism for the first toner charging brush 7 is the same as that for the second toner charging brush 6 described in the first embodiment. A moving width of reciprocation of the first toner charging brush 7 is set to 5 mm (amplitude β=2.5 mm) as in the second toner charging brush 6 of the first embodiment and is set such that an end in the longitudinal direction of a brush portion 71 of the first toner charging brush 7 does not enter an effective charging region G of the charging roller 2. Consequently, a toner, which is not charged, by the second toner charging brush is prevented from reaching the charging roller and attaching on the roller. In addition, a length in the longitudinal direction of the second toner charging brush 6 is set longer than a moving region H of the brush portion 71 of the first toner charging brush 7 so that a toner dispersed by the first toner charging brush 7 can be entirely charged. That is, a region of the photosensitive drum 1 where the second toner charging brush 6 can charge the toner is further on the inside than a region of the photosensitive drum 1 where the first toner charging brush 7 can charge the toner. Moreover, an effective charging region of the charging roller is further on the inside than a region of the photosensitive drum 1 where the second toner charging brush 6 can charge the toner.

Note that conditions for applying a voltage to the first toner charging brush 7 and the second toner charging brush 6 are the same as those in the first embodiment.

As described in the first embodiment, a state of dispersion of the attachment is often fixed in the initial stage when the attachment occurs on the photosensitive drum 1, and a state of dispersion of the toner existing on the photosensitive drum 1 at the time when it enters the charging portion "a" or the contact portion "f" shown in FIG. 2 generally corresponds to the state of dispersion of the attachment. In the case in which the position in the longitudinal direction of the second toner charging brush 6 is fixed and the first toner charging brush 7 is reciprocated as in this embodiment, a rubbing trace of the first toner charging brush 7 easily appears as a attachment pattern.

Thus, concerning a ratio of frequencies R' of the reciprocation of the first toner charging brush 7 with respect to the rotation period of the photosensitive drum 1, as in the case of R in the first embodiment, the case in which the ratio of frequencies R' is "a rational number satisfying the condition R'=m/n (m and n are integers of 5 or less)" in the range of $1/25 \leqq R' \leqq 3$ is set as the exclusion condition 1 . Moreover, it is desirable that the case in which "R' is in the range of 0.96 R' or more and 1.04 R' or less if R' of the exclusion condition 1 is an integer, and R' is in the range of 0.99 R' or more or 1.01 R' or less if R' of the exclusion condition 1 is a non-integer" is set as an exclusion condition 2 to further exclude the ratio of frequency. Thus, in this embodiment, R' is set to 4/7.

By setting R' avoiding the exclusion condition 1 and the exclusion condition 2, it is possible not to actualize an attachment pattern or streak-like attachment of the photosensitive drum 1.

Third Embodiment

Next, another embodiment of the image forming apparatus in accordance with the present invention will be described. The basic structure of the image forming apparatus of this embodiment is the same as that in the first embodiment, and the drive structures and longitudinal lengths of the first toner charging brush 7 and the second toner charging brush 6 are changed. Therefore, components having the identical structure and function as those in the first embodiment are denoted by the identical reference numerals, and a detailed description of the components will be omitted.

Figure 8:
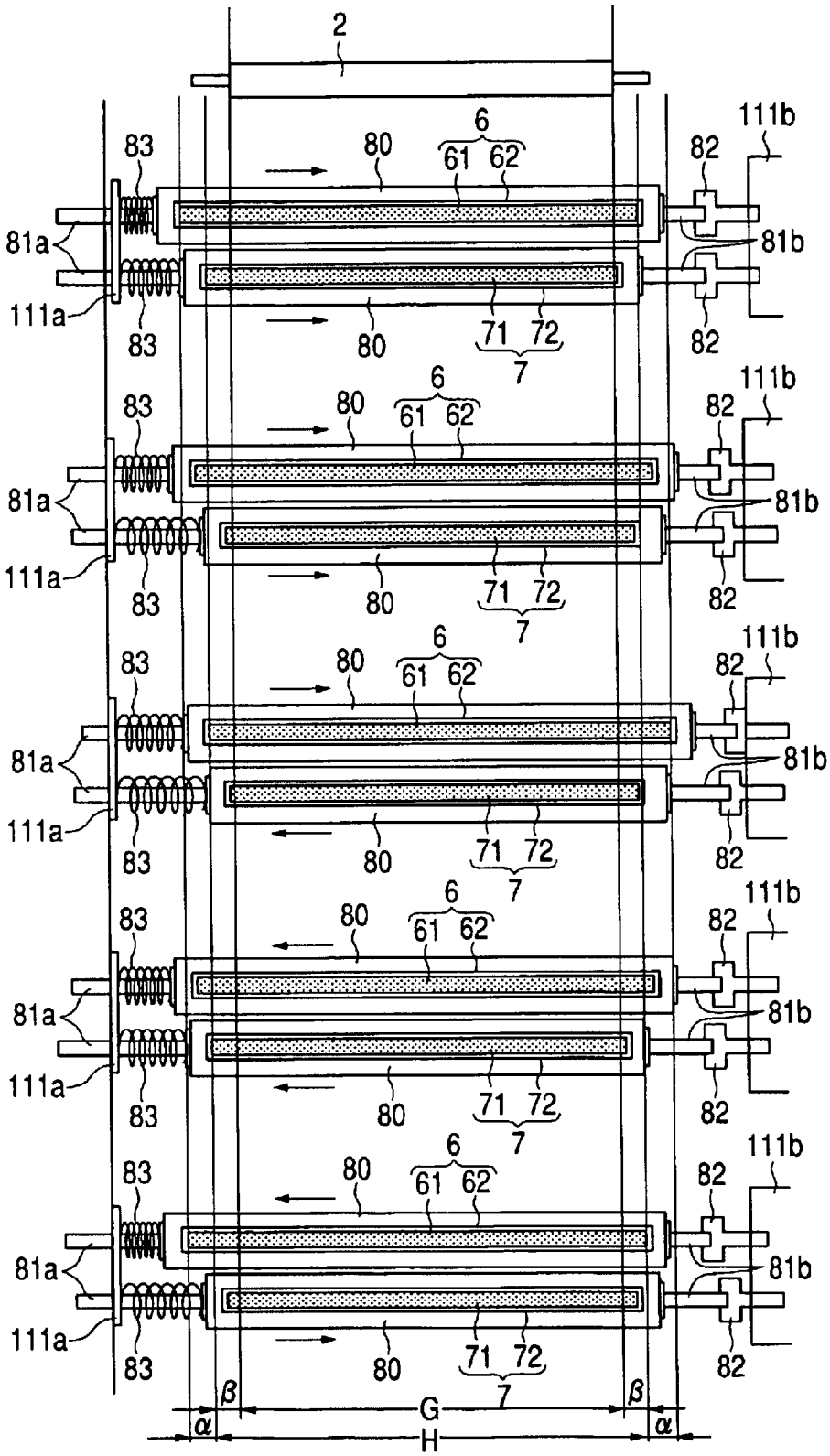
FIG. 8 is a schematic view showing an embodiment of a driving form of the residual toner uniformizing means and the toner charging means.

In this embodiment, as shown in FIG. 8, the first toner charging brush 7 is also reciprocated in the longitudinal direction of the photosensitive drum 1 in response to the rotation of the photosensitive drum 1 in addition to the second toner charging brush 6.

The second toner charging brush 6 and the first toner charging brush 7 are identical with the brush members used in the first embodiment. Further, reciprocation mechanisms for the second toner charging brush 6 and the first toner charging brush 7 are the same as that for the second toner charging brush 6 described in the first embodiment.

A moving width of the reciprocation of the first toner charging brush 7 is set to 3 mm (amplitude β=1.5 mm) and is set such that an end in the longitudinal direction of the brush portion 71 of the first toner charging brush 7 does not enter an effective charging region G of the charging roller 2. In addition, a moving width of the reciprocation of the second toner charging brush 6 is set to 4 mm (amplitude $\alpha$=2 mm). A length in the longitudinal direction of the brush portion 61 of the second toner charging brush 6 is extended by 3 mm or more with respect to the first toner charging brush 7 so that the toner dispersed by the first toner charging brush 7 can be entirely charged. The moving width of the reciprocation of the second toner charging brush 6 and the length in the longitudinal direction of the brush portion 61 of the second toner charging brush 6 are set such that an end in the longitudinal direction of the brush portion 61 of the second toner charging brush 6 does not enter a moving region H of the brush portion 71 of the first toner charging brush 7. That is, a region where the second toner charging brush 6 can charge the toner is further on the inside than a region where the first toner charging brush 7 can charge the toner. Moreover, an effective charging region of the charging roller is further on the inside than a region of the photosensitive drum 1 where the second toner charging brush 6 can charge the toner.

Exclusion conditions relating to the reciprocation of the second toner charging brush 6 and the first toner charging brush 7 of this embodiment are the same as those for the ratio of frequencies R of the second toner charging brush 6 of the first embodiment and the ratio of frequencies R' of the first toner charging brush 7 of the second embodiment, respectively. Thus, in this embodiment, the ratios of frequencies R and R' are set to 5/9 and 4/7, respectively.

Note that conditions for applying a voltage to the first toner charging brush 7 and the second toner charging brush 6 are the same as those in the first embodiment.

In this embodiment, since the dispersion effects of the second toner charging brush 6 and the first toner charging brush 7 work synergistically, attachment on the photosensitive drum 1 hardly progresses under any environmental conditions. Therefore, this is the most effective measure.

Fourth Embodiment

Figure 9:
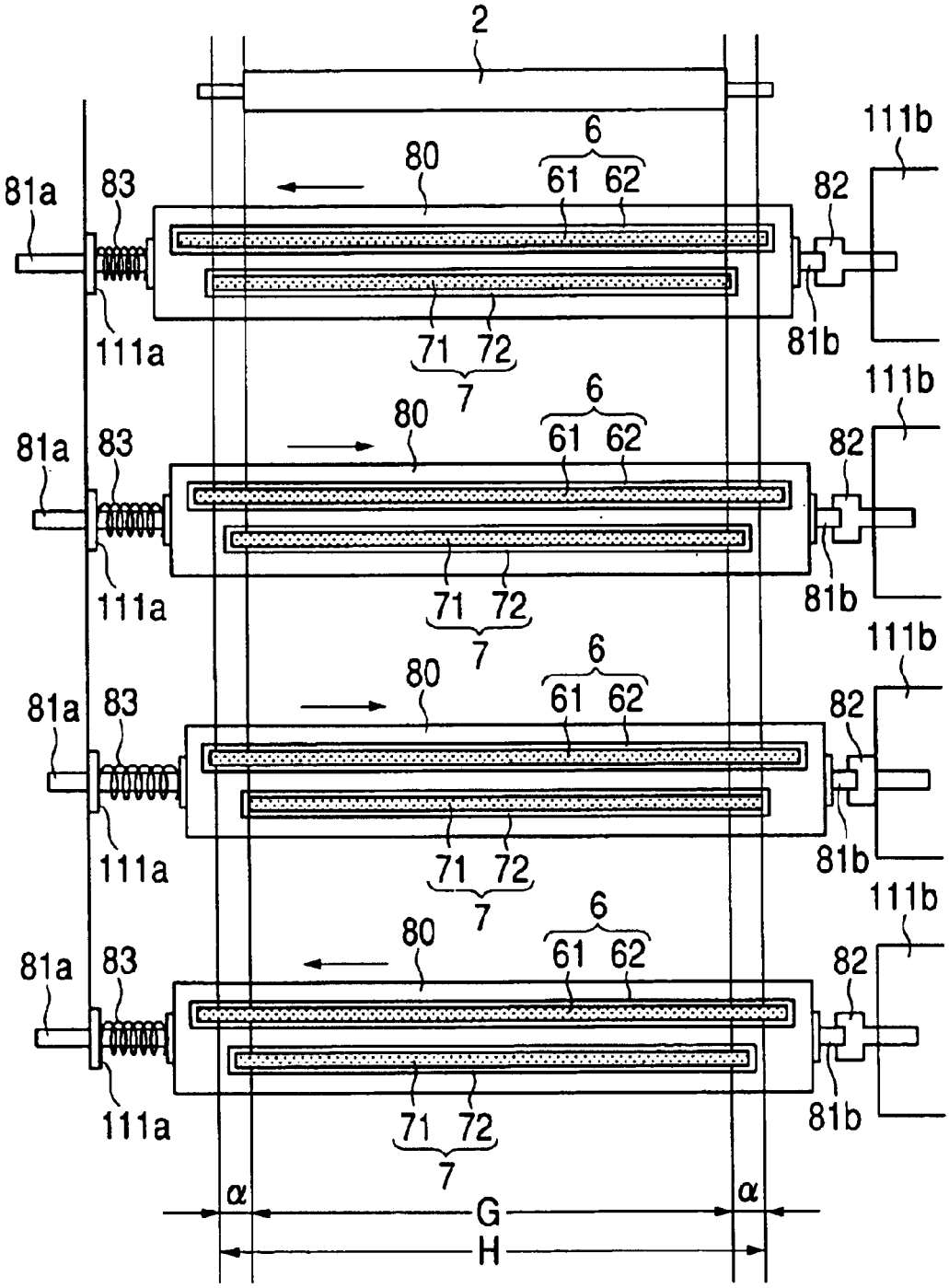
FIG. 9 is a schematic view showing another embodiment of the driving form of the residual toner uniformizing means and the toner charging means.

In the third embodiment shown in FIG. 8, the first toner charging brush 7 and the second toner charging brush 6 are reciprocated separately. As another method, as shown in FIG. 9, the first toner charging brush 7 and the second toner charging brush 6 may be set on the base 80, which is the same supporting member for both of them, and moved together (structures and actions of the base 80, the support pins 81*a* and 81*b*, the drive force transmission means 82, the return spring 83, and the like are the same as those described above).

A moving width of reciprocation of the base 80 is set to 5 mm (amplitude 2.5 mm) and set such that an end in the longitudinal direction of the brush portion 71 of the first toner charging brush 7 does not enter the effective charging region G of the charging roller 2. In addition, a length in the longitudinal direction of the brush portion 61 of the second toner charging brush 6 is extended by 2.5 mm to both sides thereof (5 mm in total) with respect to the first toner charging brush 7 so that toner dispersed by the first toner charging brush 7 can be entirely charged. The length in the longitudinal direction of the brush portion 61 of the second toner charging brush 6 is set such that the end in the longitudinal direction of the brush portion 61 of the second toner charging brush 6 does not enter the moving region H of the brush portion 71 of the first toner charging brush 7.

In this embodiment, the ratio of frequencies R of the second toner charging brush 6 and the ratio of frequencies R' of the first toner charging brush 7 are identical and set to 5/9.

In this embodiment, it is possible to prevent a attachment pattern and streak-like attachment of the photosensitive drum 1 owing to the dispersion effect of the second toner charging brush 6 and the first toner charging brush 7 and to simplify a drive system.

Note that the image bearing member may be a direct injection charging image bearing member provided with a charge injecting layer having a volume resistance of its surface of $10^9$ to $10^{14}$ Ω·cm. Even in the case in which the charge injecting layer is not used, for example, in the case in which a charge transport layer is in the above-mentioned resistance range, the equivalent effect can be obtained. In addition, an amorphous silicon photosensitive member having a volume resistance of its surface layer of about $10^{13}$ Ω·cm may be used.

In addition, as the flexible contact charging member, that of a shape or a material such as a fur brush, felt, or cloth can also be used other than the charging roller. Further, a contact charging member with more appropriate elasticity, conductivity, surface property, and durability can be obtained by combining various materials.

Further, as a waveform of an alternate voltage component (AC component; voltage with a periodically changing voltage value) of an oscillating voltage to be applied to the contact charging member or the developing member, a sine wave, a rectangular wave, a triangular wave, or the like can be used appropriately. A rectangular wave, which is formed by periodically turning ON/OFF a DC power supply, may be used.

Moreover, the image exposure means serving as information writing means for a charging surface of a photosensitive member serving as the image bearing member may be, for example, exposure means using a solid-state light-emitting device such as an LED or image exposure means using a halogen lamp, a fluorescent lamp, or the like as an original illuminating light source other than the laser scanning means of the embodiments. In short, the image exposure means may be any means as long as the means can form an electrostatic latent image corresponding to image information.

What is claimed is:

1. An image forming apparatus comprising:

an image bearing member;

charging means that charges the image bearing member;

a developing member that develops an electrostatic image formed on the image bearing member with a developer;

transfer means that transfers a developer image developed by the developing member; and developer charging means which is located further on an upstream side than the charging means in a moving direction of a surface of the image bearing member and further on a downstream side than the transfer means and which charges the developer on the image bearing member, wherein the developer charging means reciprocates in a longitudinal direction of the image bearing member, and when a number of rotations per unit time of the image bearing member is assumed to be "a" and a number of times of reciprocation per unit time of the developer charging means is assumed to be "b", assuming that R=b/a, a value of R is set in a range of $1/25 \leqq R \leqq 3$ excluding R=m/n, wherein m and n are integers of 5 or less.

2. An image forming apparatus according to claim 1, wherein a range of 0.96 R or more and 1.04 R or less is excluded if the value of R is an integer, and a range of 0.99 R or more or 1.01 R or less is excluded if the value of R is a non-integer.

3. An image forming apparatus according to claim 1, wherein, in the longitudinal direction of the image bearing member, when the developer charging means reciprocates, a part of the image bearing member corresponding to one end of the developer charging means where the developer can be charged is further on an outside than an effective charging region where the charging means charges the image bearing member.

4. An image forming apparatus according to claim 1, wherein the developing member is capable of supplying the developer onto the image bearing member and recovering a residual developer from the image bearing member during image formation.

5. An image forming apparatus according to claim 1, wherein the charging means comes into contact with the image bearing member to charge the image bearing member.

6. An image forming apparatus according to claim 1, wherein an oscillating voltage is applied to the charging means.

7. An image forming apparatus according to claim 1, wherein the developer charging means has an electroconductive fiber brush portion that comes into contact with the image bearing member.

8. An image forming apparatus comprising:

an image bearing member;

charging means that charges the image bearing member;

a developing member that develops an electrostatic image formed on the image bearing member with a developer;

transfer means that transfers a developer image developed by the developing member;

first developer charging means which is located further on an upstream side than the charging means in a moving direction of a surface of the image bearing member and further on a downstream side than the transfer means and which charges the developer on the image bearing member; and second developer charging means, which is located further on the upstream side than the charging means in the moving direction of the surface of the image bearing member and further on the downstream side than the first developer charging means and which charges the developer on the image bearing member, wherein at least one of the first developer charging means and second developer charging means reciprocates in a longitudinal direction of the image bearing member, and when a number of rotations per unit time of the image bearing member is assumed to be "a" and a number of times of reciprocation per unit time of at least one of the first developer charging means and the second developer charging means is assumed to be "b", assuming that $R=b/a$, a value of R is set in a range of $1/25 \leqq R \leqq 3$ excluding $R=m/n$, wherein m and n are integers of 5 or less.

9. An image forming apparatus according to claim 8, wherein a range of 0.96 R or more and 1.04 R or less is excluded if the value of R is an integer, and a range of 0.99 R or more or a range of 1.01 R or less is excluded if the value of R is a non-integer.

10. An image forming apparatus according to claim 8, wherein a voltage of a polarity opposite to a normal polarity of the developer is applied to the first developer charging means, and a voltage of a polarity same as the normal polarity of the developer is applied to the second developer charging means.

11. An image forming apparatus according to claim 8, wherein the first developer charging means and the second developer charging means are arranged on an identical supporting member, and the supporting member is reciprocated to reciprocate both the first developer charging means and the second developer charging means.

12. An image forming apparatus according to claim 8, wherein, in the longitudinal direction of the image bearing member, when the first developer charging means and the second developer charging means reciprocate, a part of the image bearing member corresponding to one end of the first developer charging means and the second developer charging means where the developer can be charged is further on an outside than an effective charging region where the charging means charges the image bearing member.

13. An image forming apparatus according to claim 8, wherein the first developer charging means does not reciprocate, and the second developer charging means reciprocates.

14. An image forming apparatus according to claim 13, wherein, in the longitudinal direction of the image bearing member, when the second developer charging means reciprocates, a part of the image bearing member corresponding to one end of the second developer charging means where the developer can be charged is further on an outside than an effective charging region where the charging means charges the image bearing member.

15. An image forming apparatus according to claim 8, wherein the second developer charging means does not reciprocate, and the first developer charging means reciprocates.

16. An image forming apparatus according to claim 15, wherein, in the longitudinal direction of the image bearing member, when the first developer charging means reciprocates, a part of the image bearing member corresponding to one end of the first developer charging means where the developer can be charged is further on an outside than an effective charging region where the charging means charges the image bearing member and further on an inside than a region of the image bearing member where the second developer charging means can charge the developer.

17. An image forming apparatus according to claim 8, wherein the developing member is capable of supplying the developer onto the image bearing member and recovering a residual developer from the image bearing member.

18. An image forming apparatus according to claim 8, wherein the charging means comes into contact with the image bearing member to charge the image bearing member.

19. An image forming apparatus according to claim 8, wherein an oscillating voltage is applied to the charging means.

20. An image forming apparatus according to claim 8, wherein the developer charging means has an electroconductive fiber brush portion which comes into contact with the image bearing member.

21. An image forming apparatus according to claim 8, wherein an oscillating voltage in which an AC voltage is superimposed on a DC voltage is applied to the first developer charging means.

22. An image forming apparatus according to claim 8, wherein a DC voltage exceeding a discharge initiating voltage between the second developer charging means and the image bearing member is applied to the second developer charging means.

23. An image forming apparatus according to claim 8, further comprising a plurality of image forming means each provided with at least the image bearing member, the charging means, the developing means, and the developer charging means, wherein the developer can be transferred onto a plurality of transfer members, which are moved opposing the respective image forming means, from the image bearing members of the respective image forming means.

24. An image forming apparatus according to claim 23, wherein the transfer member is an intermediate transfer member.

25. An image forming apparatus according to claim 23, further comprising a transferring material carrying member for carrying and conveying the transfer member.

26. An image forming apparatus according to claim 23, wherein the plurality of image forming means form developer images of different colors, respectively.

27. An image forming apparatus according to claim 23, wherein the plurality of image forming means are a plurality of or a single process unit constituted detachably mountable to a main body of the image forming apparatus.

* * * * *

UNITED STATES PATENT AND TRADEMARK OFFICE

CERTIFICATE OF CORRECTION

PATENT NO. : 6,928,253 B2
DATED : August 9, 2005
INVENTOR(S) : Masaki Ojima et al.

It is certified that error appears in the above-identified patent and that said Letters Patent is hereby corrected as shown below:

Column 2,
Line 1, “member)” should read -- member)”. --; and
Line 2, “”.” should be deleted.

Column 3,
Line 30, “sufficiently” should read -- sufficient --; and
Line 33, “degrades” should read -- degrade --.

Column 4,
Line 19, “period” should read -- period of --.

Column 14,
Line 26, “FIG. indicates” should read -- FIG. 5 indicates --.

Column 16,
Line 9, “changes” should read -- changed --.

Column 21,
Line 1, “or 1.01 R” should read -- or a range of 1.01 R --.

Signed and Sealed this

Twenty-second Day of November, 2005

JON W. DUDAS
*Director of the United States Patent and Trademark Office*